US008903294B2

(12) United States Patent
Miyauchi

(10) Patent No.: US 8,903,294 B2
(45) Date of Patent: Dec. 2, 2014

(54) FIXING DEVICE HAVING COVER LESS SUBJECT TO DEFORMATION

(75) Inventor: Yoshihiro Miyauchi, Ama (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 43 days.

(21) Appl. No.: 13/426,878

(22) Filed: Mar. 22, 2012

(65) Prior Publication Data

US 2012/0308276 A1 Dec. 6, 2012

(30) Foreign Application Priority Data

May 31, 2011 (JP) ..... 2011-122862

(51) Int. Cl.
*G03G 15/20* (2006.01)

(52) U.S. Cl.
CPC ..... *G03G 15/2017* (2013.01); *G03G 15/2053* (2013.01); *G03G 2215/2035* (2013.01)
USPC ..... 399/329

(58) Field of Classification Search
CPC ..... G03G 15/2053; G03G 15/2039; G03G 2215/2035
USPC ..... 399/328, 329, 330; 219/216, 619
See application file for complete search history.

(56) References Cited

U.S. PATENT DOCUMENTS

| | | | |
|---|---|---|---|
| 5,742,878 | A | 4/1998 | Kuroda |
| 5,828,035 | A | 10/1998 | Kuroda |
| 6,014,539 | A | 1/2000 | Sano et al. |
| 7,209,696 | B2 | 4/2007 | Umezawa et al. |
| 2005/0089787 | A1 | 4/2005 | Uchinokura et al. |
| 2005/0163540 | A1 | 7/2005 | Umezawa et al. |
| 2006/0233575 | A1 | 10/2006 | Uchida et al. |
| 2008/0056783 | A1 | 3/2008 | Yamamoto et al. |
| 2008/0232870 | A1 | 9/2008 | Ardery et al. |
| 2009/0142113 | A1 | 6/2009 | Kajita et al. |
| 2009/0208264 | A1 | 8/2009 | Fujiwara et al. |
| 2009/0257794 | A1 * | 10/2009 | Kaino et al. ..... 399/329 |

(Continued)

FOREIGN PATENT DOCUMENTS

| | | |
|---|---|---|
| JP | 06-003982 | 1/1994 |
| JP | 08-006409 | 1/1996 |

(Continued)

OTHER PUBLICATIONS

Co-pending U.S. Appl. No. 13/426,816, filed Mar. 22, 2012.

(Continued)

*Primary Examiner* — Sophia S Chen
(74) *Attorney, Agent, or Firm* — Banner & Witcoff, Ltd.

(57) ABSTRACT

A fixing device for thermally fixing a developing agent image to a sheet includes: a flexible tubular member having an inner peripheral surface defining an internal space; a heater disposed at the internal space; a nip member disposed at the internal space and configured to be in sliding contact with the inner peripheral surface of the flexible tubular member; a backup member nipping the flexible tubular member in cooperation with the nip member; a stay disposed at the internal space to support the nip member; and a cover disposed at the internal space and covering the stay, one of the stay and the cover being provided with a hook portion, and remaining one of the stay and the cover being provided with an engaged portion engaged with the hook portion.

23 Claims, 8 Drawing Sheets

(56) References Cited

U.S. PATENT DOCUMENTS

| | | | | |
|---|---|---|---|---|
| 2011/0058862 | A1 | 3/2011 | Yamaguchi et al. | |
| 2011/0058864 | A1 | 3/2011 | Fujimoto et al. | |
| 2011/0129267 | A1 | 6/2011 | Arimoto et al. | |
| 2011/0164906 | A1* | 7/2011 | Ishida et al. | 399/329 |
| 2011/0194882 | A1 | 8/2011 | Kitano et al. | |
| 2011/0206406 | A1 | 8/2011 | Suzuki et al. | |
| 2011/0318074 | A1* | 12/2011 | Hiramatsu | 399/329 |
| 2012/0163882 | A1* | 6/2012 | Kim et al. | 399/328 |
| 2012/0251138 | A1 | 10/2012 | Ishida et al. | |
| 2012/0251207 | A1* | 10/2012 | Ishida et al. | 399/329 |

FOREIGN PATENT DOCUMENTS

| | | |
|---|---|---|
| JP | 09-127809 | 5/1997 |
| JP | 10-247026 | 9/1998 |
| JP | 2001-147605 | 5/2001 |
| JP | 2001-356623 | 12/2001 |
| JP | 2005-166299 | 6/2005 |
| JP | 2006-047769 | 2/2006 |
| JP | 2008-233886 | 10/2008 |
| JP | 2009-053507 | 3/2009 |
| JP | 2011-170239 | 9/2011 |

OTHER PUBLICATIONS

Co-pending U.S. Appl. No. 13/426,944, filed Mar. 22, 2012.

Co-pending U.S. Appl. No. 13/426,784, filed Mar. 22, 2012.

Office Action issued in corresponding U.S. Appl. No. 13/426,816 mailed Dec. 18, 2013.

Non-Final Office Action received in corresponding U.S. Appl. No. 13/426,784 mailed Jun. 5, 2014.

Non-Final Office Action received in corresponding U.S. Appl. No. 13/426,944 mailed Jun. 5, 2014.

* cited by examiner

FIXING DEVICE HAVING COVER LESS SUBJECT TO DEFORMATION

CROSS REFERENCE TO RELATED APPLICATION

This application claims priority from Japanese Patent Application No. 2011-122862 filed May 31, 2011. The entire content of the priority application is incorporated herein by reference.

TECHNICAL FIELD

The present invention relates to a fixing device that thermally fixes a transferred developing agent image to a sheet.

BACKGROUND

A conventional thermal fixing device used in an electrophotographic image forming apparatus includes an endless fixing belt that circularly moves, a nip member disposed at an internal space defined by an inner peripheral surface of the fixing belt, a stay having a high rigidity to support the nip member, and a cover member disposed at the internal space to cover the stay. Specifically, the cover member has an outer surface whose portion contacts the fixing belt to guide the circular movement of the fixing belt.

SUMMARY

In the above-described fixing device, conceivably, the cover member may sometimes deform in a radial direction of the fixing belt due to thermal expansion or forces applied from other members. If the cover member deforms, portions of the cover member may be in contact with the fixing belt more tightly than otherwise, or portions of the cover member which are normally isolated from the fixing belt may contact the fixing belt. If this is the case, the circular movement of the fixing belt could become unstable, or possibly the fixing belt could be damaged.

In view of the foregoing, it is an object of the present invention to provide a fixing device having a cover member that is less subject to deformation in a radial direction of a fixing belt.

In order to attain the above and other objects, there is provided a fixing device for thermally fixing a developing agent image to a sheet. The fixing device includes: a flexible tubular member having an inner peripheral surface defining an internal space; a heater disposed at the internal space; a nip member disposed at the internal space and configured to be in sliding contact with the inner peripheral surface of the flexible tubular member; a backup member nipping the flexible tubular member in cooperation with the nip member; a stay disposed at the internal space to support the nip member; and a cover disposed at the internal space and covering the stay, one of the stay and the cover being provided with a hook portion, and remaining one of the stay and the cover being provided with an engaged portion engaged with the hook portion.

DETAILED DESCRIPTION

First, a general configuration of a laser printer 1 incorporating a fixing device 100 according to an embodiment of the present invention will be described with reference to FIG. 1. In the following description, a general structure of the laser printer 1 will be described first and a detailed structure of the fixing device 100 will be then described.

Throughout the specification, the terms "above", "below", "right", "left", "front", "rear" and the like will be used assuming that the laser printer 1 is disposed in an orientation in which it is intended to be used. More specifically, in FIG. 1, a right side, a left side, a near side and a far side of the laser printer 1 are referred to as a front side, a rear side, a left side and a right side, respectively.

Figure 1:
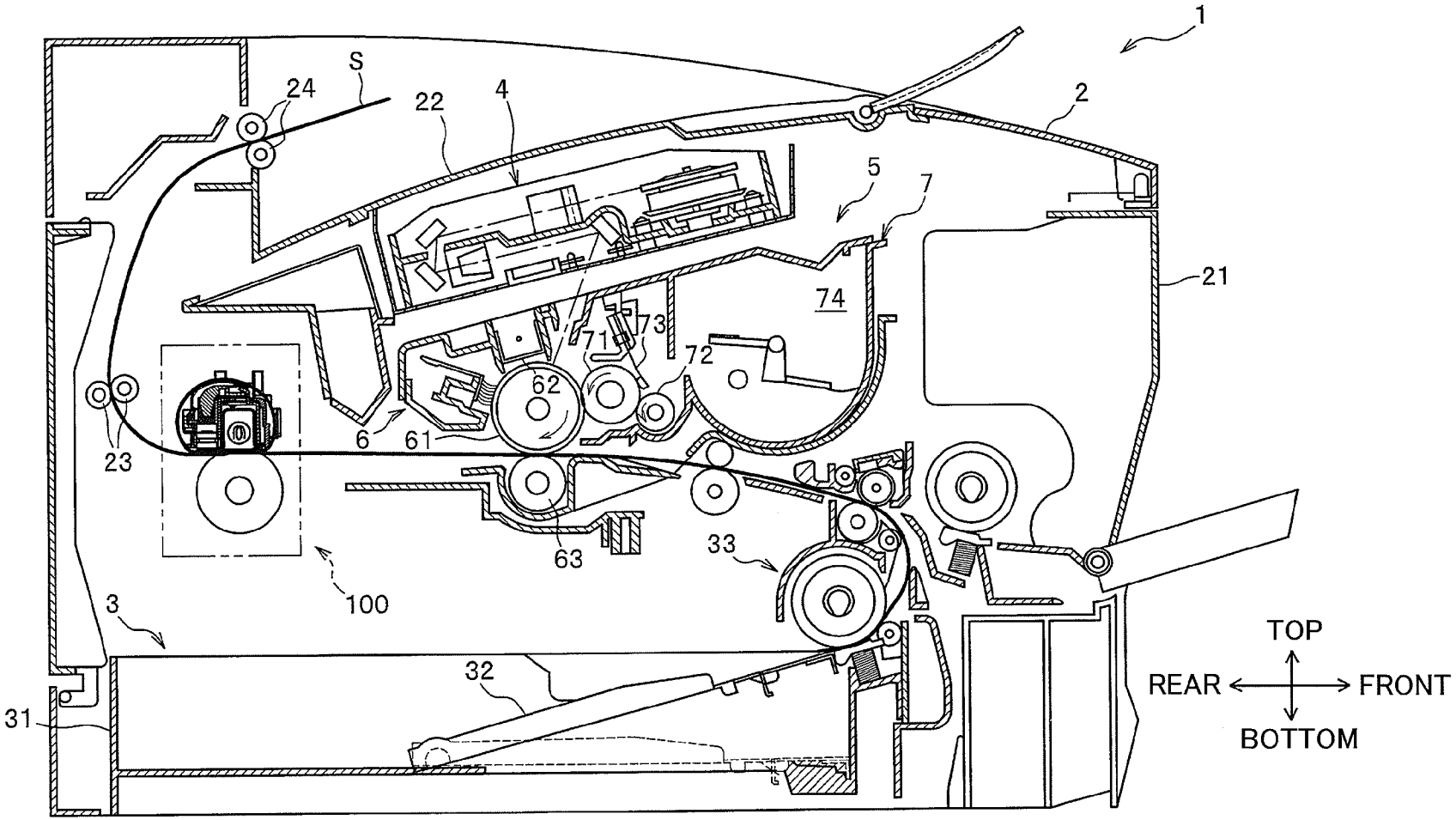
FIG. 1 is a schematic cross-sectional view illustrating a general configuration of a laser printer provided with a fixing device according to an embodiment of the present invention.

As shown in FIG. 1, the laser printer 1 includes a main frame 2 provided with a movable front cover 21. Within the main frame 2, a sheet supply unit 3 for supplying a sheet S, an exposure unit 4, a process cartridge 5 for transferring a toner image (developing agent image) on the sheet S, and the fixing device 100 for thermally fixing the toner image onto the sheet S are provided.

The sheet supply unit 3 is disposed at a lower portion of the main frame 2. The sheet supply unit 3 includes a sheet supply tray 31 for accommodating the sheet S, a lifter plate 32 for lifting up a front side of the sheet S, a sheet conveying mechanism 33. Each sheet S accommodated in the sheet supply tray 31 is lifted upward by the lifter plate 32, and is conveyed toward the process cartridge 5 by the sheet conveying mechanism 33.

The exposure unit 4 is disposed at an upper portion of the main frame 2. The exposure unit 4 includes a laser emission unit (not shown), a polygon mirror, lenses and reflection mirrors (shown without reference numerals). In the exposure unit 4, the laser emission unit emits a laser beam (indicated by a chain line in FIG. 1) based on image data such that a surface of a photosensitive drum 61 (described later) is exposed by high speed scanning of the laser beam.

The process cartridge 5 is disposed below the exposure unit 4. The process cartridge 5 is detachably loadable in the main frame 2 through an opening defined when the front cover 21 of the main frame 2 is opened. The process cartridge 5 includes a drum unit 6 and a developing unit 7.

The drum unit 6 includes the photosensitive drum 61, a charger 62, and a transfer roller 63. The developing unit 7 is detachably mounted on the drum unit 6. The developing unit 7 includes a developing roller 71, a supply roller 72, a thickness-regulation blade 73, and a toner accommodating portion 74 in which toner (developing agent) is accommodated.

In the process cartridge 5, after the surface of the photosensitive drum 61 has been uniformly charged by the charger 62, the surface is exposed to the high speed scanning of the laser beam from the exposure unit 4. An electrostatic latent image based on the image data is thereby formed on the surface of the photosensitive drum 61. The toner accommodated in the toner accommodating portion 74 is supplied to the developing roller 71 via the supply roller 72. The toner then enters between the developing roller 71 and the thickness-regulation blade 73 to be carried on the developing roller 71 as a thin layer having a uniform thickness.

The toner borne on the developing roller 71 is supplied to the electrostatic latent image formed on the photosensitive drum 61, thereby developing the electrostatic latent image into a visible toner image. The toner image is thus formed on the surface of the photosensitive drum 61. Subsequently, when the sheet S is conveyed between the photosensitive drum 61 and the transfer roller 63, the toner image formed on the photosensitive drum 61 is transferred onto the sheet S.

The fixing device 100 is disposed rearward of the process cartridge 5. The toner image (toner) transferred onto the sheet S is thermally fixed on the sheet S while the sheet S passes through the fixing device 100. The sheet S on which the toner image has been thermally fixed is then conveyed by conveying rollers 23, 24 to be discharged onto a discharge tray 22 formed on an upper surface of the main frame 2.

Next, a detailed structure of the fixing device 100 according to the embodiment of the present invention will be described with reference to FIGS. 2 through 7.

Figure 2:
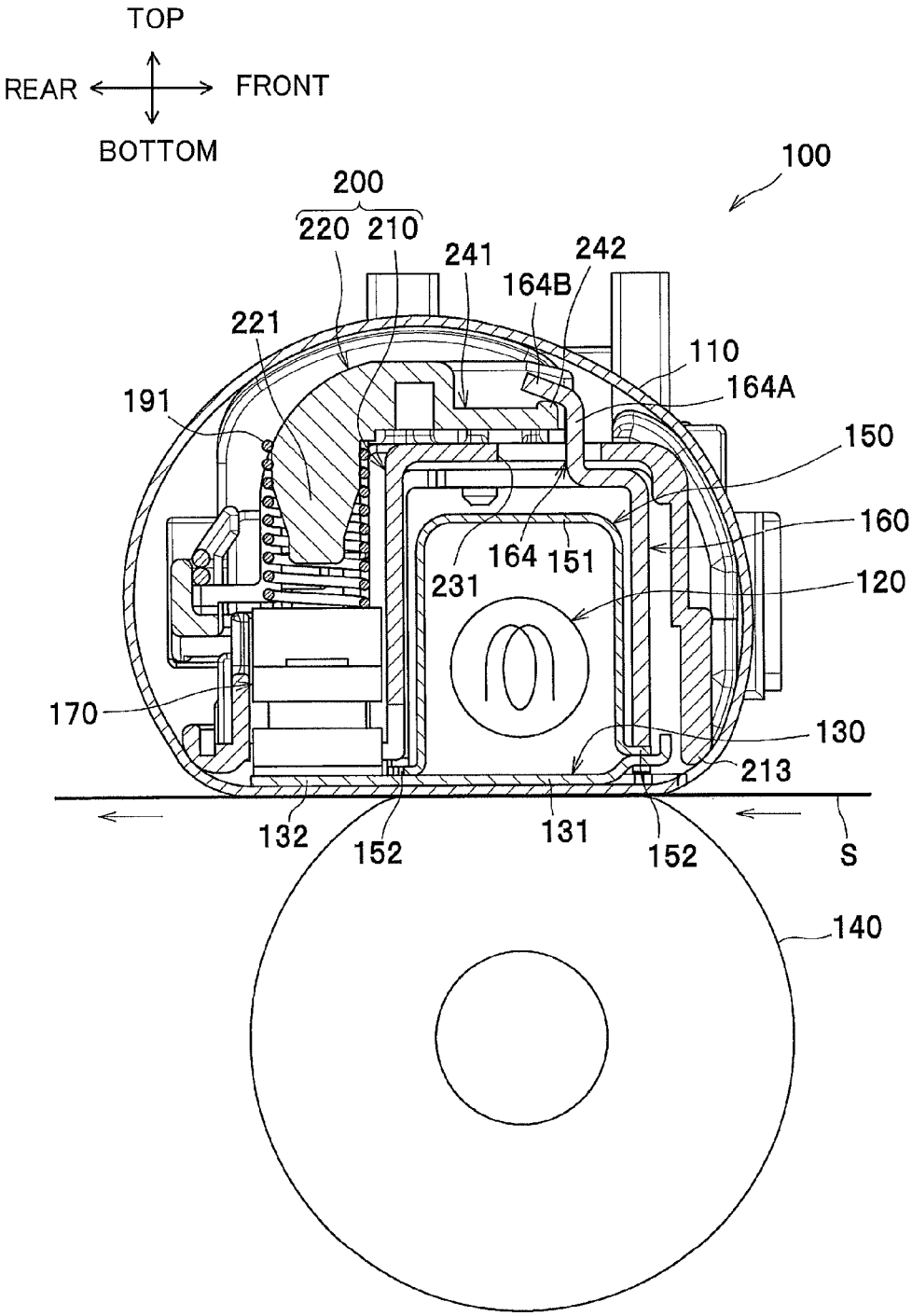
FIG. 2 is a cross-sectional view of the fixing device according to the embodiment.

As shown in FIG. 2, the fixing device 100 includes a flexible fusing belt 110 as a tubular member, a halogen lamp 120 as a heater, a nip plate 130 as a nip member, a pressure roller 140 as a backup member, a reflection member 150, a stay 160, a thermostat 170 and two thermistors 180 (see FIG. 3) as a temperature sensor, and a cover assembly 200.

In the following description, a direction in which the sheet S is conveyed (a front-to-rear direction) will be referred to as a sheet conveying direction, wherever appropriate.

Figure 3:
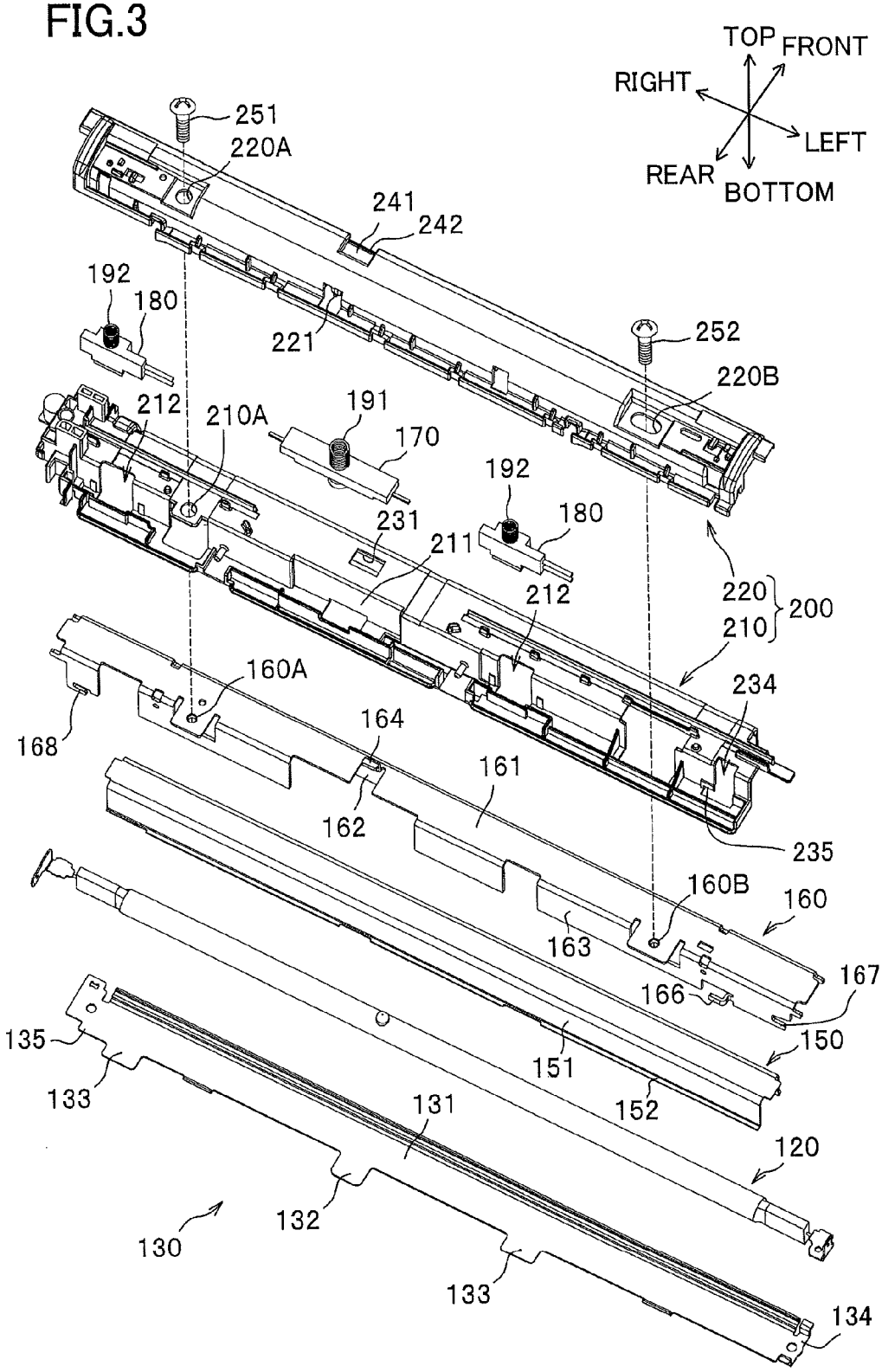
FIG. 3 is an exploded perspective view of the fixing device according to the embodiment, the fixing device including a nip plate, a halogen lamp, a reflection member, a stay, a first cover member, a second cover member, a thermostat and two thermistors.

The fusing belt 110 is of an endless belt (of a tubular configuration) having heat resistivity and flexibility. The fusing belt 110 has an inner peripheral surface that defines an internal space within which the halogen lamp 120, the nip plate 130, the reflection member 150, the stay 160 and the cover assembly 200 are disposed. The fusing belt 110 extends in a left-to-right direction, as shown in FIG. 3. Hereinafter, the left-to-right direction in which the fusing belt 110 extends may also be referred to as an axial direction of the fusing belt 110, wherever appropriate. The fusing belt 110 has widthwise end portions in the axial direction that are guided by guide members (shown without reference numerals in FIG. 3) and a guide portion 213 (described later) so that the fusing belt 110 is circularly movable. In the embodiment, a material of the fusing belt 110 is not specified. For example, the fusing belt 110 may be made from a metal, such as a stainless steel, or may be made from a resin, such as polyimide resin. Still alternatively, the fusing belt 110 may have an outer peripheral surface coated with an elastic layer such as a rubber, or the fusing belt 110 itself may be made from an elastic rubber-like resin.

The halogen lamp 120 is a heater to generate radiant heat to heat the nip plate 130 and the fusing belt 110 for heating toner on the sheet S. The halogen lamp 120 is positioned at the internal space of the fusing belt 110 such that the halogen lamp 120 is spaced away from an inner surface of the nip plate 130 by a predetermined distance.

The nip plate 130 has a plate-like shape and is adapted to receive radiant heat from the halogen lamp 120. To this effect, the nip plate 130 is positioned at the internal space of the fusing belt 110 such that the inner peripheral surface of the fusing belt 110 is slidably movable with a lower surface of the nip plate 130.

The nip plate 130 is made from a metal. In the embodiment, the nip plate 130 is made of aluminum having a thermal conductivity higher than that of the stay 160 (described later) made from a steel. For fabricating the nip plate 130, an aluminum plate is processed to provide a base portion 131, a first protruding portion 132, two second protruding portions 133, a first retained portion 134 and a second retained portion 135, as shown in FIG. 3.

The base portion 131 is flat and extends in the left-to-right direction. The base portion 131 has a lower surface that is in sliding contact with the inner peripheral surface of the fusing belt 110. The base portion 131 transmits the radiant heat from the halogen lamp 120 to the toner on the sheet S via the fusing belt 110.

The base portion 131 has a rear end portion from which the first protruding portion 132 and the two second protruding portions 133 protrude rearward respectively. Each of the first protruding portion 132 and the second protruding portions 133 has a substantially flat plate-like shape.

The first protruding portion 132 is formed at a position adjacent to a lateral center of the rear end portion of the base portion 131 in the left-to-right direction. The first protruding portion 132 has an upper surface on which the thermostat 170 is disposed to confront the same.

The two second protruding portions 133 are formed such that one of the second protruding portions 133 is arranged at a position adjacent to a right end portion of the rear end portion of the base portion 131, while the other second protruding portion 133 is arranged at a position adjacent to the lateral center of the rear end portion but leftward of the first protruding portion 132 in the left-to-right direction. Each second protruding portion 133 has an upper surface on which one of the two thermistors 180 is disposed to face the same.

The first retained portion 134 is formed at a left end portion of the nip plate 130. The first retained portion 134 has a substantially U-shape, and is engageable with first retaining portions 167 (described later) of the stay 160 when the nip plate 130 is assembled to the stay 160.

The second retained portion 135 is formed at a right end portion of the nip plate 130. Specifically, the second retained portion 135 is formed at a rear end portion of the right end portion of the nip plate 130, as shown in FIG. 3. The second retained portion 135 is engageable with a second retaining portion 168 (described later) of the stay 160.

The pressure roller 140 is disposed below the nip plate 130 such that the pressure roller 140 nips the fusing belt 110 in cooperation with the nip plate 130, as shown in FIG. 2. In the present embodiment, the nip plate 130 and the pressure roller 140 are biased toward each other so as to be in pressure contact with each other.

The pressure roller 140 is configured to rotate upon receipt of a driving force transmitted from a motor (not shown) disposed within the main frame 2. As the pressure roller 140 rotates, the fusing belt 110 is circularly moved along the nip plate 130 because of a friction force generated between the pressure roller 140 and the fusing belt 110 or between the sheet S and the fusing belt 110. The toner image on the sheet S can be thermally fixed thereto by heat and pressure during passage of the sheet S between the pressure roller 140 and the fusing belt 110.

The reflection member 150 is adapted to reflect radiant heat from the halogen lamp 120 toward the nip plate 130. As shown in FIG. 2, the reflection member 150 is positioned at the internal space of fusing belt 110 to surround the halogen lamp 120 with a predetermined distance therefrom. Thus, heat from the halogen lamp 120 can be efficiently concentrated onto the nip plate 130 to promptly heat the nip plate 130 and the fusing belt 110.

The reflection member 150 has a U-shaped cross-section and is made from a material such as aluminum having high reflection ratio regarding infrared ray and far infrared ray. Specifically, the reflection member 150 has a U-shaped reflection portion 151 and two flange portions 152 each extending outward (frontward or rearward) from each end portion of the reflection portion 151 in the front-to-rear direction.

The stay 160 is adapted to support each end portion of the nip plate 130 in the front-to-rear direction. The stay 160 is disposed at the internal space of the fusing belt 110 and covers the halogen lamp 120 and the reflection member 150. For covering the reflection member 150 and the halogen lamp 120, the stay 160 has a U-shaped configuration in conformity with an outer profile of the U-shaped reflection member 150 (reflection portion 151). That is, the stay 160 has an open end opening downward, i.e., toward the nip plate 130 and the pressure roller 140. For fabricating the stay 160, a highly rigid member such as a steel plate is folded into U-shape to provide an upper wall 161, a front wall 162, and a rear wall 163 (see FIGS. 3 and 4).

Specifically, the front wall 162 extends downward from a front end portion of the upper wall 161. As shown in FIG. 2, the front wall 162 has a bottom end portion that supports a front end portion of the nip plate 130 from upward thereof via the flange portion 152. The rear wall 163 has a bottom end portion that supports a rear end portion of the nip plate 130 from upward thereof via the flange portion 152. In other words, the nip plate 130 and the stay 160 nip the flange portions 152 of the reflection member 150 therebetween.

The stay 160 is adapted to receive a force applied to the nip plate 130 from below (from the pressure roller 140) and to support the nip plate 130. Here, the force applied to the nip plate 130 from the pressure roller 140 refers to a biasing force from the pressure roller 140.

The upper wall 161 has a rear end portion from which two fixing portions (shown without reference numerals in FIG. 3) protrude rearward. Specifically, the two fixing portions (right and left fixing portions) are formed at positions separated from each other in the left-to-right direction. A screw hole 160A is formed on one of the fixing portions (the right fixing portion), while a screw hole 160B is formed at the other fixing portion (the left fixing portion). Screws 251, 252 are respectively screwed into the screw holes 160A, 160B, as shown in FIG. 3. The cover assembly 200 (described later) is thus threadingly fixed to the stay 160 by the screws 251, 252.

Figure 4:
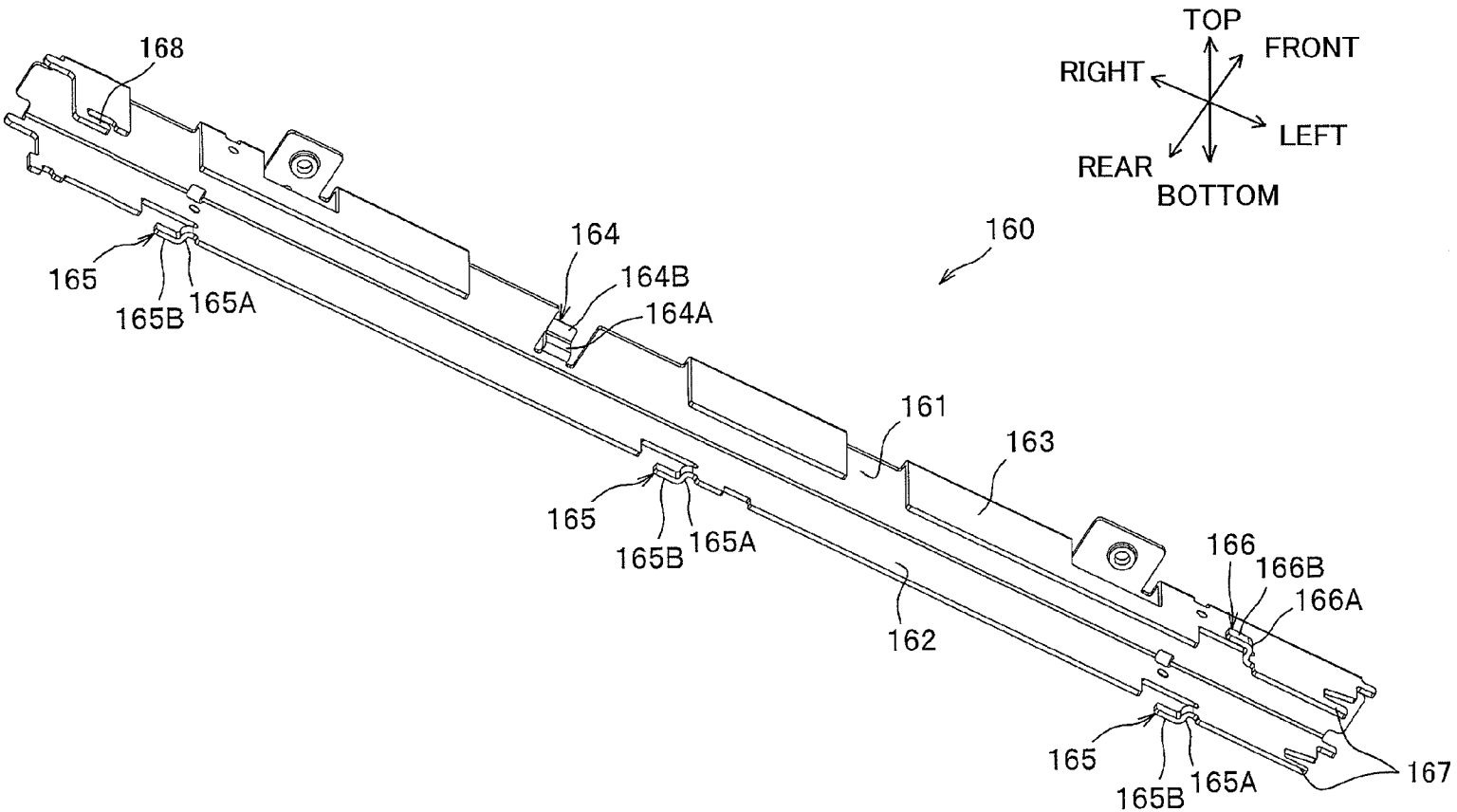
FIG. 4 is a perspective view of the stay according to the embodiment as viewed from below.

As shown in FIGS. 3 and 4, the stay 160 includes the pair of first retaining portions 167 and the second retaining portion 168.

Each first retaining portion 167 is formed on a left end portion of each of the rear wall 163 and the front wall 162. The first retaining portions 162 are adapted to be engaged with the first retained portion 134 of the nip plate 130 when the nip plate 130 is assembled to the stay 160.

The second retaining portion 168 is formed at a right end portion of the rear wall 163. The second retaining portion 162 is adapted to be engaged with the second retained portion 135 of the nip plate 130 when the stay 160 is assembled to the nip plate 130.

The stay 160 to which the nip plate 130 has been assembled is supported to a casing (not shown) of the fixing device 100. Due to engagement between the first retained portion 134 and the first retaining portions 167 and between the second retained portion 135 and the second retaining portion 168, the nip plate 130 is stably held to the stay 160 when the nip plate 130 is assembled to the stay 160. In other words, the nip plate 130 is supported to the casing (not shown) of the fixing device 100 via the stay 160.

As shown in FIG. 4, the stay 160 is further formed with a first hook portion 164, three second hook portions 165 and a third hook portion 166.

The first hook portion 164 is formed on the upper wall 161 at a position substantially center of the stay 160 in the left-to-right direction. Specifically, the first hook portion 164 is formed by cutting a portion of the upper wall 161 (a portion substantially adjacent to a lateral center of the upper wall 161 in the left-to-right direction) and by raising the same such that the first hook portion 164 protrudes upward from the upper wall 161 to provide a first extending portion 164A and a first engaging portion 164B. The first extending portion 164A extends upward from the upper wall 161. The first engaging portion 164B extends diagonally upward and rearward from a tip end portion of the first extending portion 164A (also see FIG. 2).

The three second hook portions 165 are formed at a lower end portion of the front wall 162 (an end portion facing toward the nip plate 130) such that one of the second hook portions 165 is formed at a position substantially center in the left-to-right direction; another second hook portion 165 at a left end portion; and a remaining second hook portion 165 at a right end portion of the lower end portion of the front wall 162 in the left-to-right direction. Each second hook portion 165 is formed by cutting the lower end portion of the front wall 162 and by raising the same such that each second hook portion 165 protrudes frontward. Each second hook portion 165 includes a second extending portion 165A and a second engaging portion 165B. Each second extending portion 165A extends frontward from the lower end portion of the front wall 162. Each second engaging portion 165B extends rightward from a tip end portion of each second extending portion 165A.

The third hook portion 166 is formed at a left end portion of the rear wall 163. Specifically, the third hook portion 166 is formed by cutting a lower end portion of the left end portion of the rear wall 163 and by raising the same rearward such that the third hook portion 166 protrudes rearward. The third hook portion 166 includes a third extending portion 166A and a third engaging portion 166B. The third extending portion 166A extends rearward from the lower end portion of the rear wall 163. The third engaging portion 166B extends rightward from a tip end portion of the third extending portion 166A. That is, tip end portions of the three second hook portions 165 and the third hook portion 166 are all oriented rightward (i.e., in the same direction as one another).

The thermostat 170 is configured to detect a temperature of the nip plate 130. The thermostat 170 has a lower surface serving as a temperature detecting surface. As shown in FIG. 2, the thermostat 170 is disposed at the internal space of the fusing belt 110 such that the lower surface of the thermostat 170 opposes the upper surface of the first protruding portion 132 of the nip plate 130. Further, the thermostat 170 is adapted to be coupled to a first positioning portion 211 (described later) formed on a first cover member 210 of the cover assembly 200. The thermostat 170 is thus positioned in the front-to-rear direction as well as in the left-to-right direction. The thermostat 170 is biased toward the first protruding portion 132 (toward the pressure roller 140) by a coil spring 191. With this construction, the thermostat 170 is stably positioned relative to the nip plate 130. Hence, the thermostat 170 can detect the temperature of the nip plate 130 with accuracy.

The thermistors 180 are temperature sensors configured to detect the temperature of the nip plate 130. Each thermistor 180 has a lower surface serving as a temperature detecting surface. The two thermistors 180 are disposed at the internal space of the fusing belt 110 such that the lower surface of each thermistor 180 opposes the upper surface of each second protruding portion 133 of the nip plate 130.

Further, each thermistors 180 is adapted to be coupled to each second positioning portion 212 (described later) formed on the first cover member 210 of the cover assembly 200. The thermistors 180 are thus positioned in the front-to-rear direction as well as in the left-to-right direction. Each thermistor 180 is further biased toward each second protruding portion 133 (toward the pressure roller 140) by a coil spring 192. With this construction, the thermistors 180 are stably positioned relative to the nip plate 130. The thermistors 180 can therefore detect the temperature of the nip plate 130 with accuracy.

The cover assembly 200 is adapted to support the thermostat 170, the thermistors 180 and the coil springs 191, 192. The cover assembly 200 is disposed at the internal space of the fusing belt 110 so as to cover the stay 160. The cover assembly 200 may be formed of a liquid crystal polymer, a PEEK resin (polyether ether ketone resin), or a PPS resin (polyphenylene sulfide resin), for example.

The cover assembly 200 includes the first cover member 210 and a second cover member 220, as shown in FIG. 3.

The first cover member 210 extends in the left-to-right direction and has a substantially U-shaped cross-section for covering the stay 160 to provide an upper wall, front wall and a rear wall (shown without reference numerals). As shown in FIGS. 3 and 5 to 7, the first cover member 210 includes a first open portion 231, three second engaged portions 232, a third engaged portion 235, the guide portion 213 for guiding the circular movement of the fusing belt 110 (also see FIG. 2), the first positioning portion 211 for positioning the thermostat 170, two second positioning portions 212 each for positioning each thermistor 180, and a through-hole 210A.

The first open portion 231 is formed on the upper wall of the first cover member 210 to penetrate therethrough. Specifically, the first open portion 231 is formed at a position substantially center of the upper wall of the first cover member 210, the position corresponding to the position of the first hook portion 164 of the stay 160 in the left-to-right direction.

Figure 5:
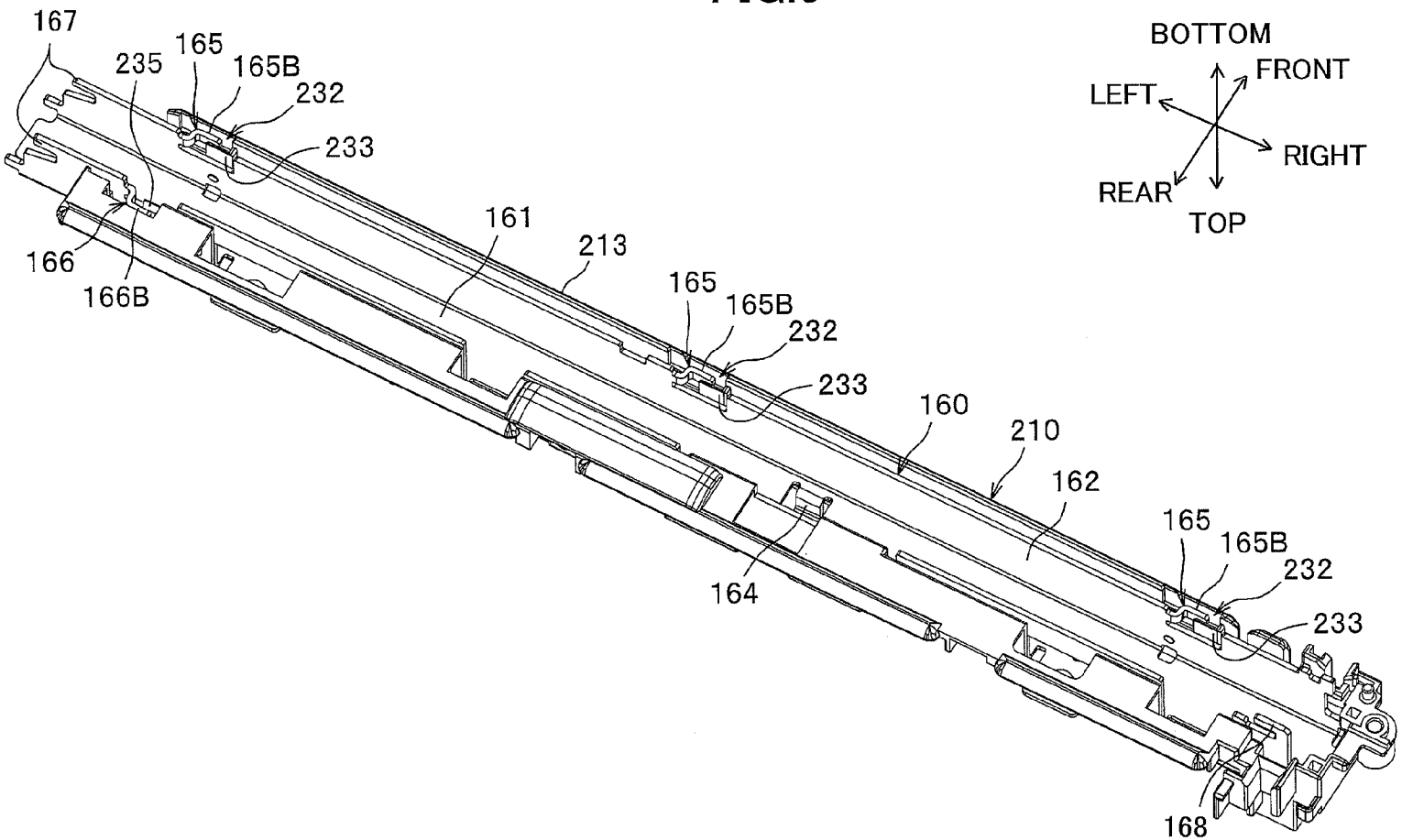
FIG. 5 is a perspective view of the stay and the first cover member according to the embodiment, wherein the stay and the first cover member are assembled to each other and viewed from below.

Referring to FIG. 5, the three second engaged portions 232 are formed on the front wall of the first cover member 210 each at a position corresponding to the position of each second hook portion 165 of the stay 160. Specifically, the three second engaged portions 232 are formed at a lower end portion of the front wall of the first cover member 210 such that one of the second engaged portions 232 is disposed at a position substantially center of the first cover member 210 in the left-to-right direction; another second engaged portion 232 at a left end portion; and remaining one second engaged portion 232 at a right end portion of the lower end portion of the front wall of the first cover member 210 in the left-to-right direction. Each second engaged portion 232 includes a depressed portion (shown without reference numerals) and a hook 233. The depressed portion is depression formed on an inner surface of the front wall of the first cover member 210 and is adapted to accommodate therein the corresponding second hook portion 165. The hook 233 is positioned rightward of the depressed portion in the left-to-right direction. Each hook 233 has a substantially L-shape, protruding inward (rearward) from the inner surface of the front wall of the first cover member 210 and then extending leftward. In other words, each hook 233 has a tip end portion oriented leftward in the left-to-right direction. Each hook 233 is engageable with each second hook portion 165 when the first cover member 210 is assembled to the stay 160.

The third engaged portion 235 is adapted to engage the third hook portion 166 of the stay 160 and is formed on the rear wall of the first cover member 210 at a position corresponding to the position of the third hook portion 166. Specifically, the third engaged portion 235 is formed at a left end portion of the rear wall of the first cover member 210 and is defined by an opening 234 penetrating through the rear wall in the front-to-rear direction (see FIG. 3).

The guide portion 213 is formed at the lower end portion of the front wall of the first cover member 210 such that the guide portion 213 spans an entire length of the sheet S in the left-to-right direction. The guide portion 213 has a curved cross-section that protrudes toward the inner peripheral surface of the fusing belt 110, as shown in FIG. 2. The guide portion 213 is in sliding contact with the inner peripheral surface of the fusing belt 110 for guiding the fusing belt 110 moving toward a region between the nip plate 130 and the backup roller 140.

The through-hole 210A is formed on the upper wall of the first cover member 210 for allowing the screw 251 to penetrate therethrough.

As shown in FIGS. 2 and 3, the second cover member 220 has a substantially L-shaped cross-section and extends in the left-to-right direction. The second cover member 220 has an upper wall on which a first engaged portion 241, three supporting portions 221 (only one is shown in FIG. 3), a circular hole 220A and an oblong hole 220B are formed.

Specifically, the first engaged portion 241 is formed on the upper wall of the second cover member 220 at a position substantially center in the left-to-right direction, more specifically, at a position corresponding to the position of the first hook portion 164 of the stay 160. The first engaged portion 241 has a substantially rectangular shape in a top view, and is formed by depressing a front end portion of the upper wall, as shown in FIGS. 2 and 3. The first engaged portion 241 has a front edge portion protruding upward, as shown in FIG. 2. This front edge portion of the first engaged portion 241 serves as a protruding potion 242. The protruding potion 242 spans an entire length of the first engaged portion 241 in the left-to-right direction (see FIG. 3).

The position of the first engaged portion 241 also corresponds to the position of the coil spring 191 in the left-to-right direction (axial direction). Here, "correspond" not only means that the first engaged portion 241 (or the first hook portion 164 engaging the first engaged portion 241) and the coil spring 191 share a center completely coincident with each other, but also means that the first engaged portion 241 (or the first hook portion 164) and the coil spring 191 partially overlap with each other in the axial direction. With this arrangement, due to the engagement between the first engaged portion 241 and the first hook portion 164, deformation (displacement) of the cover assembly 200 attributed to the biasing force of the coil spring 191 can be effectively suppressed.

Each supporting portion 221 has a boss-like shape, protruding downward from a lower surface of the upper wall of the second cover member 220 for supporting one of the coil springs 191, 192.

The screws 251, 252 are inserted into the circular hole 220A and the oblong hole 220B respectively for threadingly fixing the cover assembly 200 (the first cover member 210 and the second cover member 220) to the stay 160.

For assembling the cover assembly 200 to the stay 160, the stay 160 is coupled to and accommodated in the first cover member 210 from below, as shown in FIG. 5. At this time, each second hook portion 165 is engaged with each second engaged portion 232 and the third hook portion 166 is engaged with the third engaged portion 235, while the stay 160 is being coupled to the first cover member 210. Alternatively, the stay 160 may be first accommodated in the first cover member 210 such that the stay 160 occupies a position offset slightly leftward from a state of FIG. 5 (a state where the stay 160 and the first cover member 210 are completely assembled to each other), and the stay 160 may then be slid rightward such that the second hook portions 165 and the third hook portion 166 are engaged with the second engaged portions 232 and the third engaged portion 235 respectively.

It should be noted that, since the second hook portions 165 protrude outward (frontward) from the front wall 162 and the third hook portion 166 protrudes outward (rearward) from the rear wall 163, the engagement between the second hook portions 165 and the second engaged portions 232 and between the third hook portion 166 and the third engaged portion 235 can be easily achieved by sliding (moving) the stay 160 in the left-to-right direction. Alternatively, the hook 233 of each second engaged portion 232 and the third engaged portion 235 may be formed such that, the tip end portions of each hook 233 and the third engaged portion 235 are oriented gradually inward in the front-to-rear direction. Specifically, the hook 233 may extend diagonally rearward and leftward from the front wall of the first cover member 210, while the third engaged portion 235 may extend diagonally frontward and leftward from the rear wall of the first cover member 210.

Figure 7:
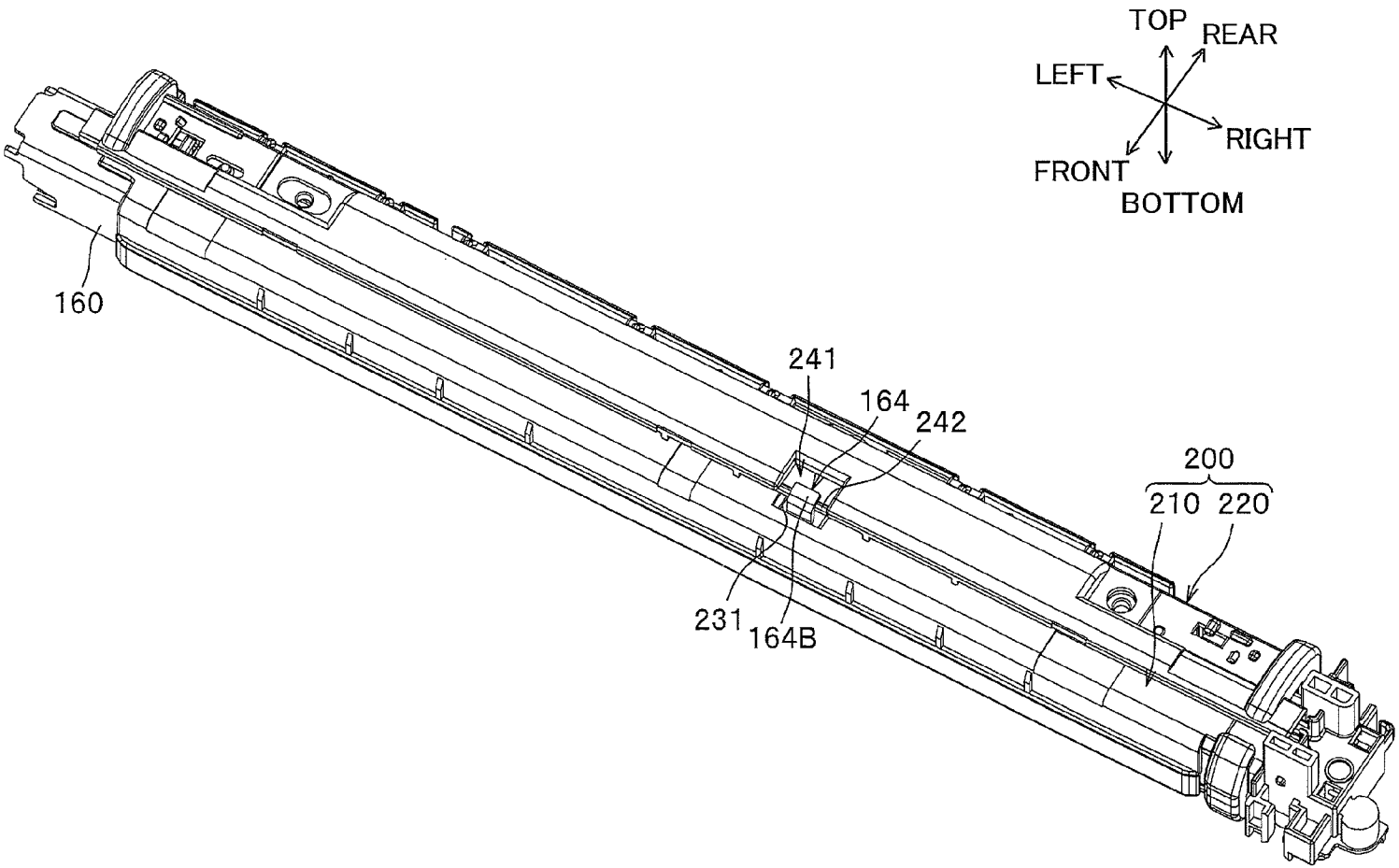
FIG. 7 is a perspective view of the stay, the first cover member and the second cover member according to the embodiment, wherein the stay, the first cover member and the second cover member are assembled to one another and viewed from above.

Subsequently, as shown in FIG. 7, the second cover member 220 is mounted on the first cover member 210 to which the stay 160 has been assembled. Specifically, the second cover member 220 is mounted on the first cover member 210 from upward thereof. At this time, the first engaged portion 241 of the second cover member 220 is engaged with the first hook portion 164 of the stay 160. Next, the screw 251 is screwed into the screw hole 160A via the circular hole 220A and the through-hole 210A. Likewise, the screw 252 is screwed into the screw hole 160B via the oblong hole 220B. The cover assembly 200 is thus threadingly fixed to the stay 160.

When the stay 160 has been assembled to the cover assembly 200, each second hook portion 165 is accommodated in each second engaged portion 232, and the second engaging portion 165B of each second hook portion 165 opposes the corresponding hook 233 in the front-to-rear direction, which is coincident with the sheet conveying direction, as shown in FIG. 5. With this construction, even when the front wall of the first cover member 210 is subject to thermal deformation causing expansion in a radial direction of the fusing belt 110 and the lower end portion of the front wall of the first cover member 210 is prompted to move (expand) frontward, each second engaging portion 165B formed on the highly rigid stay 160 abuts on the corresponding hook 233 to restrict such frontward movement of the lower end portion of the front wall of the first cover member 210. Thus, deformation of the front wall of the first cover member 210 due to the thermal expansion can be effectively suppressed.

In the embodiment, the guide portion 213 is formed on the lower portion of the front wall of the first cover member 210. Hence, a large force may possibly be exerted on the fusing belt 110 if the guide portion 213 is caused to deform. To this effect, in the present embodiment, the three second hook portions 165 are formed on the lower end portion of the front wall 162 at three different positions substantially equally distanced from one another in the left-to-right direction: one at the substantially center; another at the right end portion; and the remaining one at the left end portion of the lower end portion of the front wall 162 in the left-to-right direction. Hence, deformation of the front wall of the first cover member 210 can be reliably suppressed, leading to stable circular movement of the fusing belt 110 and suppression of damages to the fusing belt 110.

Figure 6:
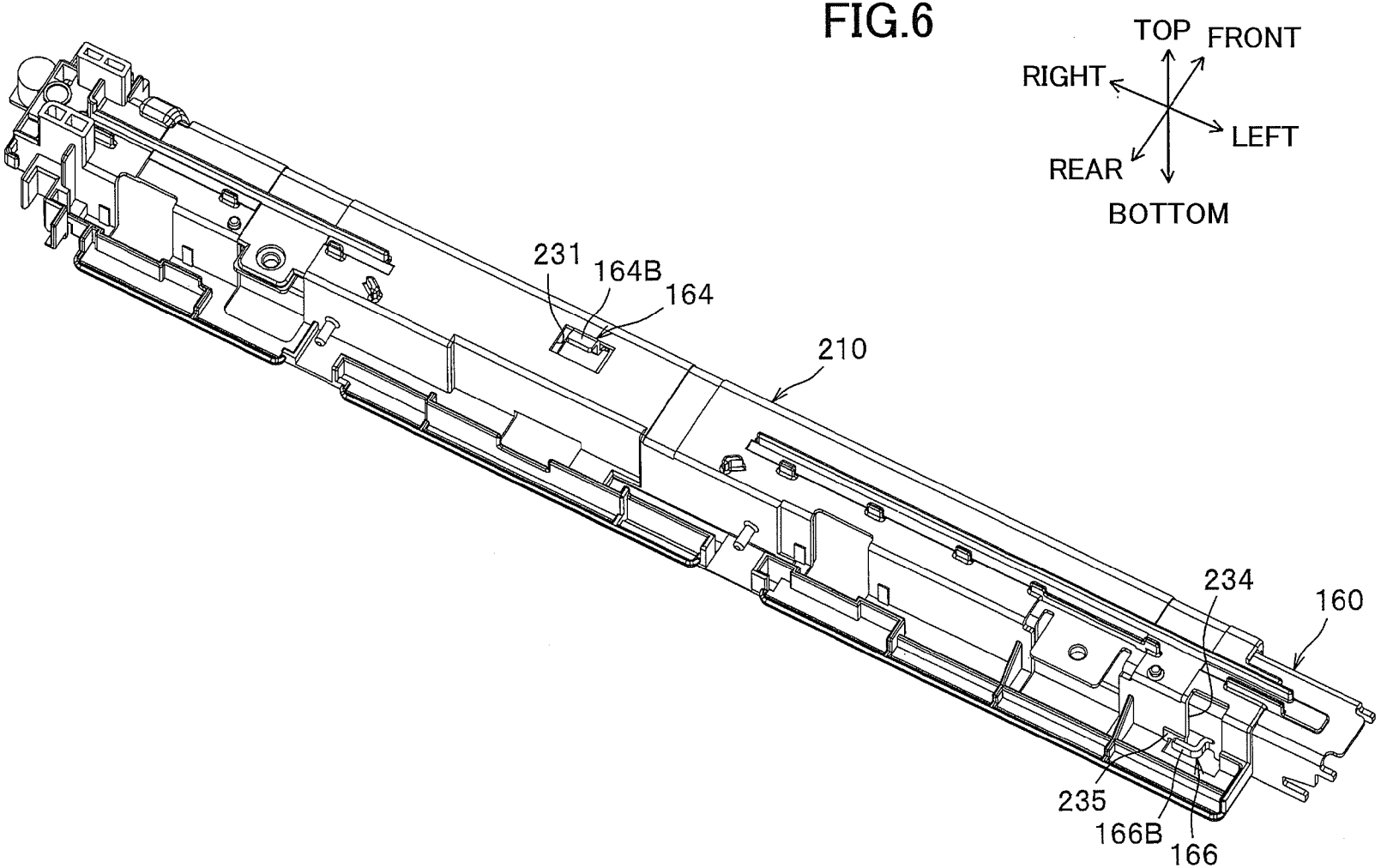
FIG. 6 is a perspective view of the stay and the first cover member according to the embodiment, wherein the stay and the first cover member are assembled to each other and viewed from above.

As shown in FIG. 6, when the first cover member 210 is assembled to the stay 160, the third hook portion 166 protrudes outward (rearward) of the first cover member 210 through the opening 234 such that the third engaging portion 166B opposes the third engaged portion 235 in the front-to-rear direction (in the sheet conveying direction). If the rear wall of the first cover member 210 deforms to expand in the radial direction of the fusing belt 110 due to heat applied from the halogen lamp 120, the lower end portion of the rear wall of the first cover member 210 is likely to move rearward. Nonetheless, in the present embodiment, such rearward movement of the lower end portion of the rear wall of the first cover member 210 can be restricted due to engagement between the third engaging portion 166B and the third engaged portion 235. As a result, deformation of the rear wall of the first cover member 210 can be suppressed.

Further, the first hook portion 164 protrudes outward (upward) of the first cover member 210 through the first open portion 231 when the first cover member 210 is assembled to the stay 160. When the second cover member 220 is then assembled to the first cover member 210 to which the stay 160 has been assembled, as shown in FIG. 7, the first hook portion 164 protruding from the first cover member 210 engages the first engaged portion 241 formed on the second cover member 220. More specifically, the first hook portion 164 is engaged with the first hook portion 164 such that a lower surface of the first engaging portion 164B is in contact with the protruding potion 242, as shown in FIG. 2. Due to this engagement between the first hook portion 164 and the first engaged portion 241, biasing forces of the coil springs 191, 192 can be received by the second cover member 220 (specifically, by the upper wall of the second cover member 220). The second cover member 220 is thus suppressed from being deformed (displaced) upward. Further, since the first hook portion 164 and the first engaged portion 241 are provided at a position identical to that of the coil spring 191 in the left-to-right direction, displacement of the second cover member 220 attributed to the biasing force of the coil spring 191 can be reliably suppressed.

Conceivably, significant deformation and/or displacement of the cover assembly 200 causes the cover assembly 200 to be brought into contact with the fusing belt 110 in an inappropriate manner. For example, the guide portion 213 may be caused to deform (displace) frontward such that the guide portion 213 is strongly pressed against the inner peripheral surface of the fusing belt 110. Or, possibly, portions of the cover assembly 200, which are normally separated from the inner peripheral surface of the fusing belt 110, may be in contact with the inner peripheral surface of the fusing belt 110. Such abnormal contacts between the cover assembly 200 and the fusing belt 110 may lead to unstable circular movement of the fusing belt 110 and may cause damages to the fusing belt 110. According to the present embodiment, however, the stay 160 having a high rigidity is formed with the first hook portion 164, the second hook portions 165 and the third hook portion 166, while the cover assembly 200 is formed with the first engaged portion 241, the second engaged portions 232 and the third engaged portion 235 respectively engageable with the first hook portion 164, the second hook portions 165 and the third hook portion 166. Therefore, even if the cover assembly 200 is subject to thermal deformation in the radial direction of the fusing belt 110, the cover assembly 200 is less likely to deform significantly due to the engagement between the first hook portion 164 and the first engaged portion 241, between each second hook portion 165 and each hook 233, and between the third hook portion 166 and the third engaged portion 235. As a result, the circular movement of the fusing belt 110 can be made stable and any damages to the fusing belt 110 can be prevented.

Further, the first hook portion 164 engaged with the first engaged portion 241 is in an orientation to receive the biasing forces of the coil springs 191, 192. Hence, displacement of the cover assembly 200 attributed to the biasing force of the coil springs 191, 192 can be suppressed.

Further, the first hook portion 164 and the first engaged portion 241 are formed at a position corresponding to the position of the coil spring 191 in the left-to-right direction. Therefore, the portion of the second cover member 220 receiving the biasing force of the coil spring 191 can be particularly less susceptible to displacement.

Further, in the present embodiment, the second hook portions 165 and the third hook portion 166 are respectively engaged with the second engaged portions 232 and the third engaged portion 235 such that the first cover member 210 is restricted from moving in the front-to-rear direction (in the sheet conveying direction). Hence, the first cover member 210 is less likely to thermally deform (expand) in the sheet conveying direction due to the heat from the halogen lamp 120.

Further, since the second hook portions 165 are provided at the substantially center and each widthwise end portion of the stay 160 in the left-to-right direction (in the axial direction), deformation of the first cover member 210 can be reliably suppressed, compared to a case where only one second hook portion 165 is provided in the left-to-right direction.

When the first cover member 210 is subject to deformation, the lower end portions of the first cover member 210 (the lower end portion of the front wall of the first cover member 210 and the lower end portion of the rear wall of the first cover member 210) are most likely to deform (expand) in the radial direction of the fusing belt 110. To this effect, in the present embodiment, the second hook portions 165 and the third hook portion 166 are provided at the lower end portions of the front wall 162 and the rear wall 163 of the stay 160 respectively. Hence, deformation of the lower end portions of the first cover member 210 can be mitigated due to the hooking of the second hook portions 165 and the third hook portion 166 respectively with the second engaged portions 232 and the third engaged portion 235 formed at the first cover member 210.

Further, each of the first hook portion 164, the second hook portions 165 and the third hook portion 166 is formed by cutting and raising a portion of the stay 160 made from a metal plate. Forming the first hook portion 164, the second hook portions 165 and the third hook portion 166 on the stay 160 is thus realized with ease. Further, since the reflection member 150 is disposed inward of the stay 160, the radiant hear from the halogen lamp 120 is prevented from escaping outward of the stay 160 through openings formed by cutting and raising portions of the stay 160.

Various changes and modifications are conceivable.

For example, in the depicted embodiment, the hook portions (the first hook portion 164, the second hook portions 165 and the third hook portion 166) are provided at the stay 160, while the engaged portions (the first engaged portion 241, the second engaged portions 232 and the third engaged portion 235) are provided at the cover assembly 200. However, alternatively, the hook portions may be formed on the cover assembly 200 and the engaged portions may be formed on the stay 160.

Figure 8:
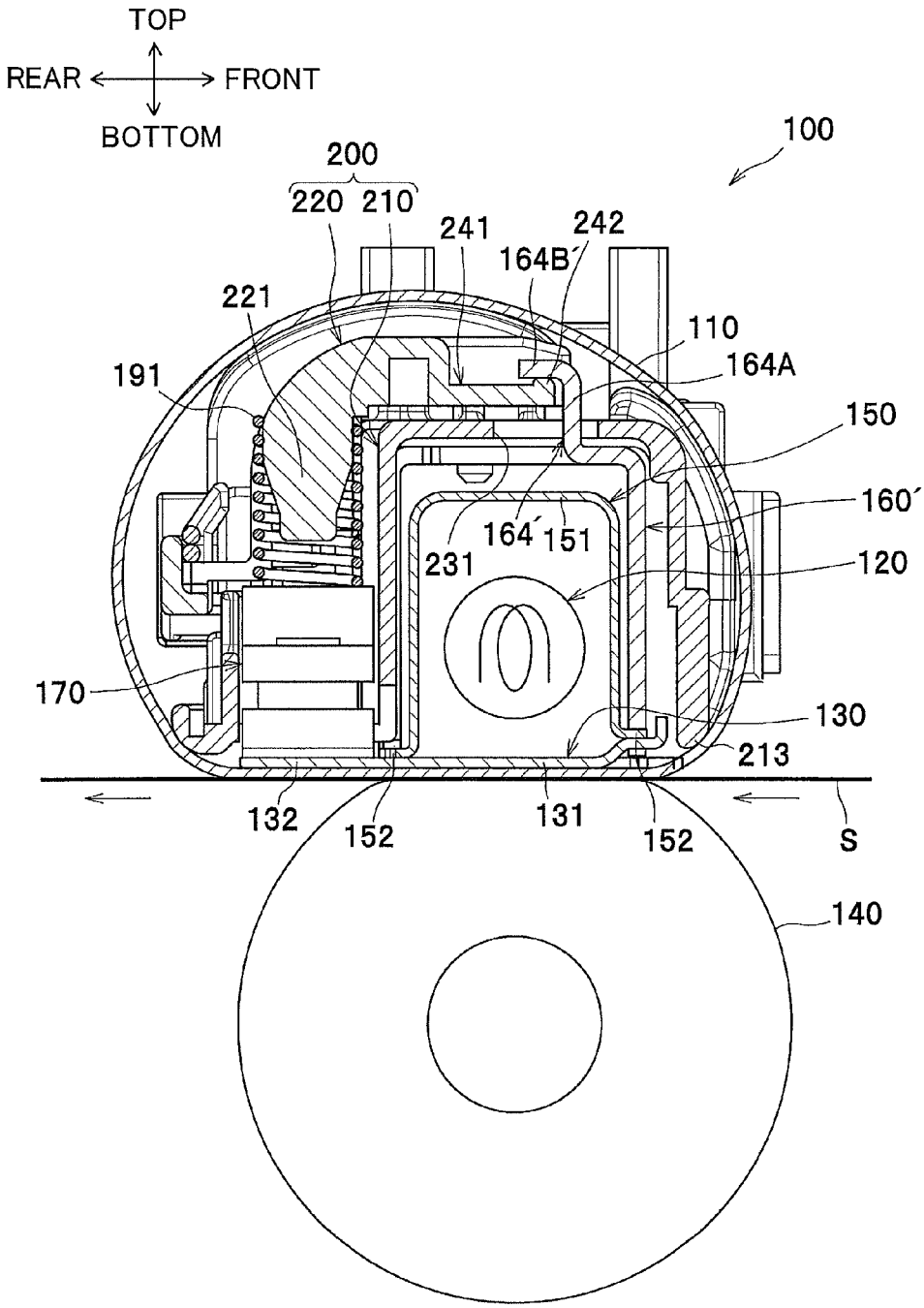
FIG. 8 is a cross-sectional view of a fixing device according to a variation of the embodiment.

FIG. 8 shows a first hook portion 164' of a stay 160' according to a variation of the embodiment. Unlike the first hook portion 164 of the depicted embodiment having the first engaging portion 164B extending diagonally upward and rearward, the first hook portion 164' according to the variation has a first engaging portion 164B' extending horizontally rearward. With this construction, engagement between the first hook portion 164' and the first engaged portion 241 can be secured, thereby preventing the stay 160 and the second cover member 220 from moving relative to each other.

Further, instead of the nip plate 130 and the halogen lamp 120, a plate-like ceramic heater may be employed as a single component that plays both roles of the nip plate 130 and the halogen lamp 120.

Further, instead of the pressure roller 140, a belt-like pressure member is also available as the backup member.

Further, the sheet S can be an OHP sheet instead of a plain paper and a postcard.

In the depicted embodiment, the present invention is applied to the monochromatic laser printer 1 as an example of an image forming apparatus. However, the present invention may also be applicable to a color laser printer, and other image forming apparatuses such as a copying machine and a multifunction device provided with an image scanning device such as a flat head scanner.

While the invention has been described in detail with reference to the embodiments thereof, it would be apparent to those skilled in the art that various changes and modifications may be made therein without departing from the spirit of the invention.

What is claimed is:

1. A fixing device comprising:

a flexible tubular member having an inner peripheral surface defining an internal space;

a heater extending through the internal space;

a nip member extending through the internal space and configured to contact the inner peripheral surface of the flexible tubular member;

a backup member configured to nip the flexible tubular member in cooperation with the nip member;

a stay extending through the internal space and supporting the nip member; and a cover extending through the internal space and covering at least a portion of the stay, one of the stay and the cover being provided with a hook portion, and the other one of the stay and the cover being provided with an engaged portion engaged with the hook portion, wherein the engaged portion comprises a protrusion engageable with the hook portion.

2. The fixing device as claimed in claim 1, further comprising:

a temperature sensor.

3. The fixing device as claimed in claim 2, wherein the flexible tubular member defines an axis extending in an axial direction; and wherein one of the hook portion and the engaged portion is at a position corresponding to that of the temperature sensor in the axial direction.

4. The fixing device as claimed in claim 2, wherein the temperature sensor is disposed at the internal space.

5. The fixing device as claimed in claim 1, wherein the inner peripheral surface of the flexible tubular member is configured to slide relative to the nip member in a sliding direction; and wherein the hook portion engaged with the engaged portion has an orientation to restrict the cover from moving in the sheet conveying direction.

6. The fixing device as claimed in claim 1, wherein the stay comprises a metal frame.

7. The fixing device as claimed in claim 6, wherein the cover comprises a resin frame.

8. The fixing device as claimed in claim 1, wherein the stay has a substantially U-shape.

9. The fixing device as claimed in claim 1, wherein the engaged portion has a hook shape.

10. The fixing device as claimed in claim 1, wherein the stay comprises the hook portion.

11. The fixing device as claimed in claim 1, wherein the cover comprises the hook portion.

12. A fixing device comprising:

a flexible tubular member having an inner peripheral surface defining an internal space;

a heater extending through the internal space;

a nip member extending through the internal space and configured to contact the inner peripheral surface of the flexible tubular member;

a backup member configured to nip the flexible tubular member in cooperation with the nip member;

a stay extending through the internal space and supporting the nip member; and a cover extending through the internal space and covering at least a portion of the stay, one of the stay and the cover being provided with a hook portion, and the other one of the stay and the cover being provided with an engaged portion engaged with the hook portion, wherein the engaged portion is in a form of a hook engageable with the hook portion.

13. The fixing device as claimed in claim 12, wherein the stay comprises a metal frame.

14. The fixing device as claimed in claim 13, wherein the cover comprises a resin frame.

15. The fixing device as claimed in claim 12, wherein the stay has a substantially U-shape.

16. The fixing device as claimed in claim 12, wherein the stay comprises the hook portion.

17. The fixing device as claimed in claim 12, wherein the cover comprises the hook portion.

18. A fixing device comprising:

a flexible tubular member having an inner peripheral surface defining an internal space;

a heater extending through the internal space;

a nip member extending through the internal space and configured to be in contact with the inner peripheral surface of the flexible tubular member;

a backup member configured to nip the flexible tubular member in cooperation with the nip member;

a stay extending through the internal space and supporting the nip member;

a cover extending through the internal space and covering at least a portion of the stay, one of the stay and the cover being provided with a hook portion, and the other one of the stay and the cover being provided with an engaged portion engaged with the hook portion; and a reflection member configured to reflect a radiant heat from the heater toward the nip member, the stay covering the reflection member.

19. The fixing device as claimed in claim 18, wherein the stay comprises a metal frame.

20. The fixing device as claimed in claim 19, wherein the cover comprises a resin frame.

21. The fixing device as claimed in claim 18, wherein the stay has a substantially U-shape.

22. The fixing device as claimed in claim 18, wherein the stay comprises the hook portion.

23. The fixing device as claimed in claim 18, wherein the cover comprises the hook portion.

* * * * *